US008069997B2

(12) United States Patent
Cheng

(10) Patent No.: US 8,069,997 B2
(45) Date of Patent: Dec. 6, 2011

(54) PORTABLE TOOL RACK

(76) Inventor: Chin-Shun Cheng, Taichung (TW)

( * ) Notice: Subject to any disclaimer, the term of this patent is extended or adjusted under 35 U.S.C. 154(b) by 45 days.

(21) Appl. No.: 12/814,455

(22) Filed: Jun. 13, 2010

(65) Prior Publication Data

US 2010/0252515 A1 Oct. 7, 2010

Related U.S. Application Data

(63) Continuation-in-part of application No. 12/212,650, filed on Sep. 18, 2008, now Pat. No. 7,815,058.

(51) Int. Cl.
*A47F 7/00* (2006.01)

(52) U.S. Cl. ..... 211/70.6; 211/60.1; 206/349; 206/372; 206/376

(58) Field of Classification Search ..... 211/70.6, 211/69, 87.01, 60.1, 4, 70.8; 206/372, 373, 206/376, 377, 378
See application file for complete search history.

(56) References Cited

U.S. PATENT DOCUMENTS 1,877,466 A * 9/1932 Koster ..... 206/376
3,360,116 A * 12/1967 Tolmie et al. ..... 206/45.2
5,203,469 A * 4/1993 Chang et al. ..... 220/812
6,305,542 B1 * 10/2001 Barbrow ..... 206/376
6,978,890 B2 * 12/2005 Pangerc et al. ..... 206/349
7,168,559 B2 * 1/2007 Chen ..... 206/373
7,188,726 B2 * 3/2007 Lin ..... 206/373
7,210,578 B2 * 5/2007 Tuan-Mu et ..... 206/378
7,360,654 B2 * 4/2008 Liu ..... 206/754
7,681,731 B1 * 3/2010 Chern ..... 206/372
2002/0070185 A1 * 6/2002 Chen ..... 211/70.6
2003/0141266 A1 * 7/2003 Lin ..... 211/70.6
2004/0000497 A1 * 1/2004 Huang ..... 206/376
2005/0056559 A1 * 3/2005 Chen ..... 206/372
2005/0056560 A1 * 3/2005 Chen ..... 206/373
2007/0114150 A1 * 5/2007 Lin ..... 206/372

* cited by examiner

*Primary Examiner* — Darnell Jayne
*Assistant Examiner* — Patrick Hawn

(57) ABSTRACT

A tool rack includes a frame having two sidewalls and two slots are defined through the two sidewalls. A plurality of recesses are defined in the frame and a rod having second recesses is connected between the two sidewalls. A restriction member is connected to the frame and two distal ends of the restriction member are movably engaged with the slots of the frame. The restriction member includes third recesses which are located in alignment with the recesses so that the tools are engaged with the first, second and third recesses. A stop plate extends from a distal end of an inside of each third recess so as to prevent the tools from disengaging from these recesses. When shifting the restriction member, the stop plates are moved away from the recesses so that the tools can be picked out from the tool rack.

10 Claims, 10 Drawing Sheets

PORTABLE TOOL RACK

RELATED APPLICATION

This application is a Continuation-in-Part of U.S. application Ser. No. 12/212,650, entitled "PORTABLE TOOL RACK", naming Chin-Shun Cheng as inventor, and filed on 18 Sep. 2008 now U.S. Pat. No. 7,815,058.

FIELD OF THE INVENTION

The present invention relates to a portable tool rack with restriction member to position the tools in the rack and the tools are arranged to save space of the rack.

BACKGROUND OF THE INVENTION

A conventional tool rack is disclosed in U.S. patent application Ser. No. 11/616,856 now U.S. Pat. No. 7,584,845 and includes a frame with a slide groove and multiple recesses which are located on two sides of the slide groove so as to receive the tools. The recesses each are composed of two clamp plates and each clamp plate has a spring piece which biases the tool to position the tool within the recesses. A restriction member is slidably connected to the frame and includes multiple restriction portions which are snapped on the tools to preventing the tools from disengaging from the recesses. At least one locking member connects the restriction member to the frame.

However, the clamp plates protrude from the frame and easily tangle the user's sleeves or clothes. The multiple clamp plates are arranged on the whole frame and make the frame look awkward. The tools are received in the frame at an angle and this occupies a lot of space so that the frame becomes bulky. The function ends of the tools protrude out from the frame and may be hit by stiff parts during working and this may damage the function ends. The tool rack can only accommodate fixed sizes of tools and which is not convenient for the users.

The present invention intends to provide a portable tool rack for carrying tools such as wrenches which are well positioned and can be arranged to save space required.

SUMMARY OF THE INVENTION

The primary object of the present invention is to provide a tool rack that arranges the tools to be received within a minimum space, and have the functions of easy for use and fabrication. For achieve aforementioned object, the tool rack is design comprising: a frame having two sidewalls and a plurality of recesses for engaging a shank of a tool; a rod being connected the two sidewalls opposite to the recesses for the engagement of the function end of the tool; and a restriction member including a restriction bar pivotably connected to the frame by a pivotal mechanism. Wherein, the pivotal mechanism comprising: two pivots and two positioning slots being provided on the sidewalls of the frame and the connection portions of the restriction member respectively, each positioning slot including interlinked a guiding slot and a circular hole with a bigger diameter than the width of the guiding slot, each positioning slot being penetrated by one pivot and allowing the pivot to move along the circular hole and the guiding slot; and two opposite sides of the inner wall of the guiding slot being provided a limit surface thereon respectively, and two opposite sides of the outer periphery of the pivot being provided a limit portion thereon respectively; so that the restriction bar can be rotated with respect to the frame when the pivot is positioned in the circular hole, and the restriction bar can not be rotated with respect to the frame when the pivot is positioned in the guiding slot and the limit surface contact with the limit portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
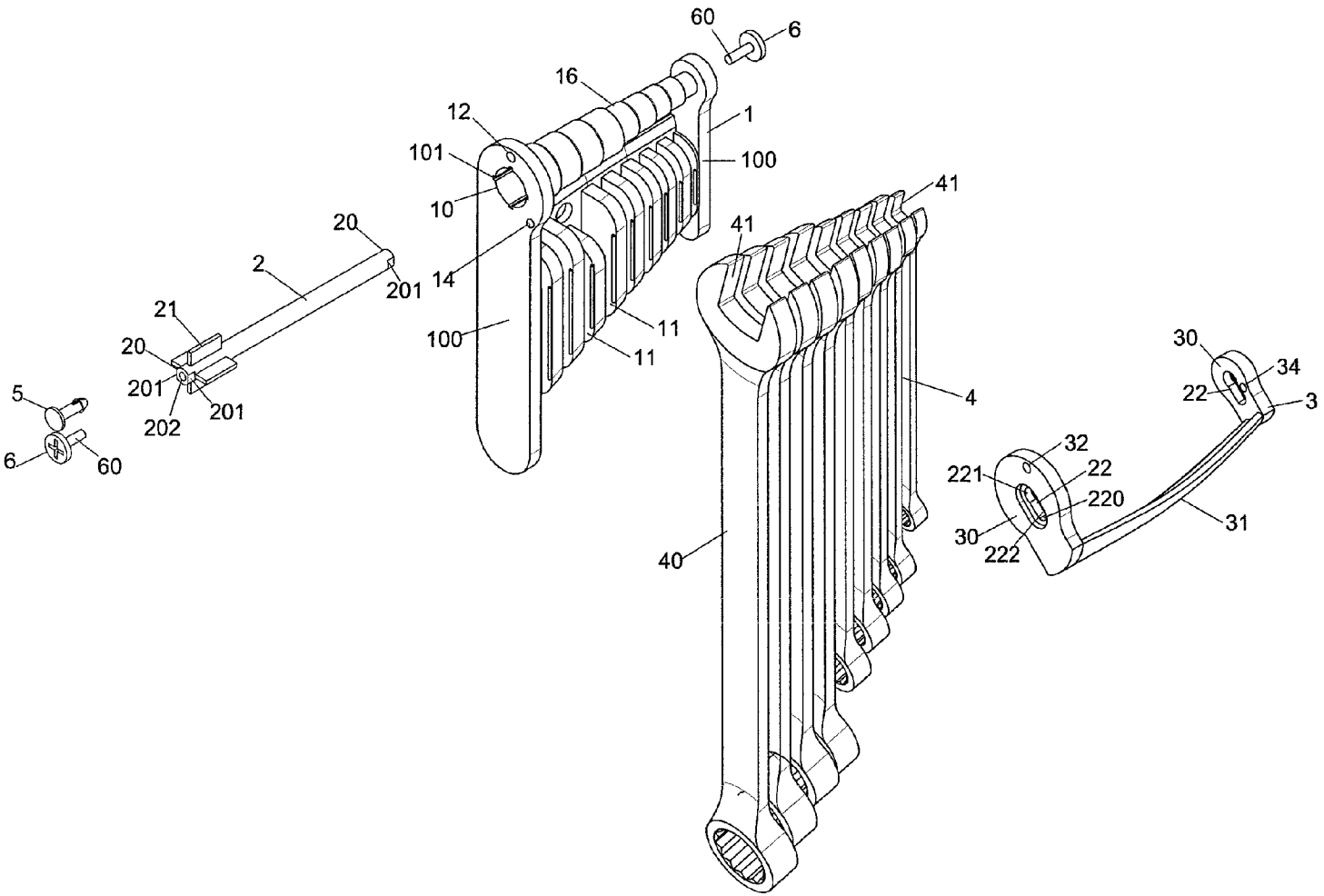
FIG. 1 is an exploded view to show the tool rack of the present invention.

I. The Basic Feature of Technology of the Present Invention

Referring to FIGS. 1, and 9~12, the tool rack of the present invention comprises a frame 1 having two sidewalls 100 and a plurality of recesses 11 defined in the frame 1 each for engaging a shank 40 of a tool 4. A protrusion 111 extends from at least one inside of each recess 1 so as to form a narrow opening for holding the shank 40 of the tool 4. A rod 16 is connected between the two sidewalls 100 and opposite to the recesses 1, which is provided for the engagement of the function end 41 of the tool 4. A restriction member 3 comprises a restriction bar 31 and two connection portion 30 provided on two ends of the restriction bar 31 respectively. The two connection portions 30 are pivotably connected to the two sidewalls 100 of the frame 1 by a pivotal mechanism, and the restriction member 3 can be rotated with respect to the frame 1 and about the axis of the rod 16, so that the restriction bar 31 can be positioned to close or unclose the recesses 11.

The characterization of the present invention is each pivotal mechanism comprising: two pivots 20 and two positioning slots 22 are provided on the sidewall 100 of the frame 1 and the connection portions 30 of the restriction member 3 respectively, and one end of the pivot 20 provided a clasper 6 with an outer diameter bigger than the pivot 20; and each positioning slot 22 includes interlinked a guiding slot 220 and a circular hole 221, the circular hole 221 is with a bigger diameter than the width of the guiding slot 220; each positioning slot 22 is penetrated by one pivot 20 and allows the pivot 20 to move along the circular hole 221 and the guiding slot 220; the two opposite sides of the inner wall of the guiding slot 220 each provided a limit surface 222, the two opposite sides of the outer periphery of each pivot 20 is provided a limit portion 201 respectively; so that the connection portions 30 and the restriction bar 31 can be rotated with respect to the sidewall 100 and the frame 1 when the pivot 20 is positioned in the circular hole 221, and the connection portions 30 and the restriction bar 31 can not be rotated with respect to the sidewall 100 and the frame 1 when the pivot 20 is positioned in the guiding slot 220 and the limit surface 222 contact with the limit portion 201.

The connection portion 30 of the restriction member 3 includes a through hole 32, a locking pin 5 extends through the through hole 32 and engaged with a snap hole 12 on the sidewall 100 of the frame 1. The connection portion 30 of the restriction member 3 further includes a cavity 34 which is provided for engaging with a protruding 14 on the sidewall 100. The rod 16 can be stepped to match different size of the opening of the function end 41 respectively.

II. The Embodiment of the Pivotal Mechanism of the Present Invention i. First Embodiment of the Pivotal Mechanism

As shown in FIG. 1, two pivots 20 are defined on the two end of a shaft 2, each sidewall 100 includes a hole 10, the periphery of shaft 2 is defined at least a flange 21 thereon, the inner wall of one hole 10 defined at least a slot 101 thereon, the shaft 2 is inserted in the rod 16 along the longitudinal line of the rod 16, the flange 21 engages with the slot 101 and remain the pivots 20 partially protruding outward from the hole 10 with respect to the sidewall 100, so that the two pivots 20 are provided on the two sidewalls 100 of the frame 1 respectively. Moreover, two positioning slots 22 are provided on the two connection portions 30 of the restriction member 3 respectively. As aforementioned configuration, two pivots 20 and two positioning slots 22 are provided on the sidewall 100 and the connection portions 30 respectively.

Figure 9:
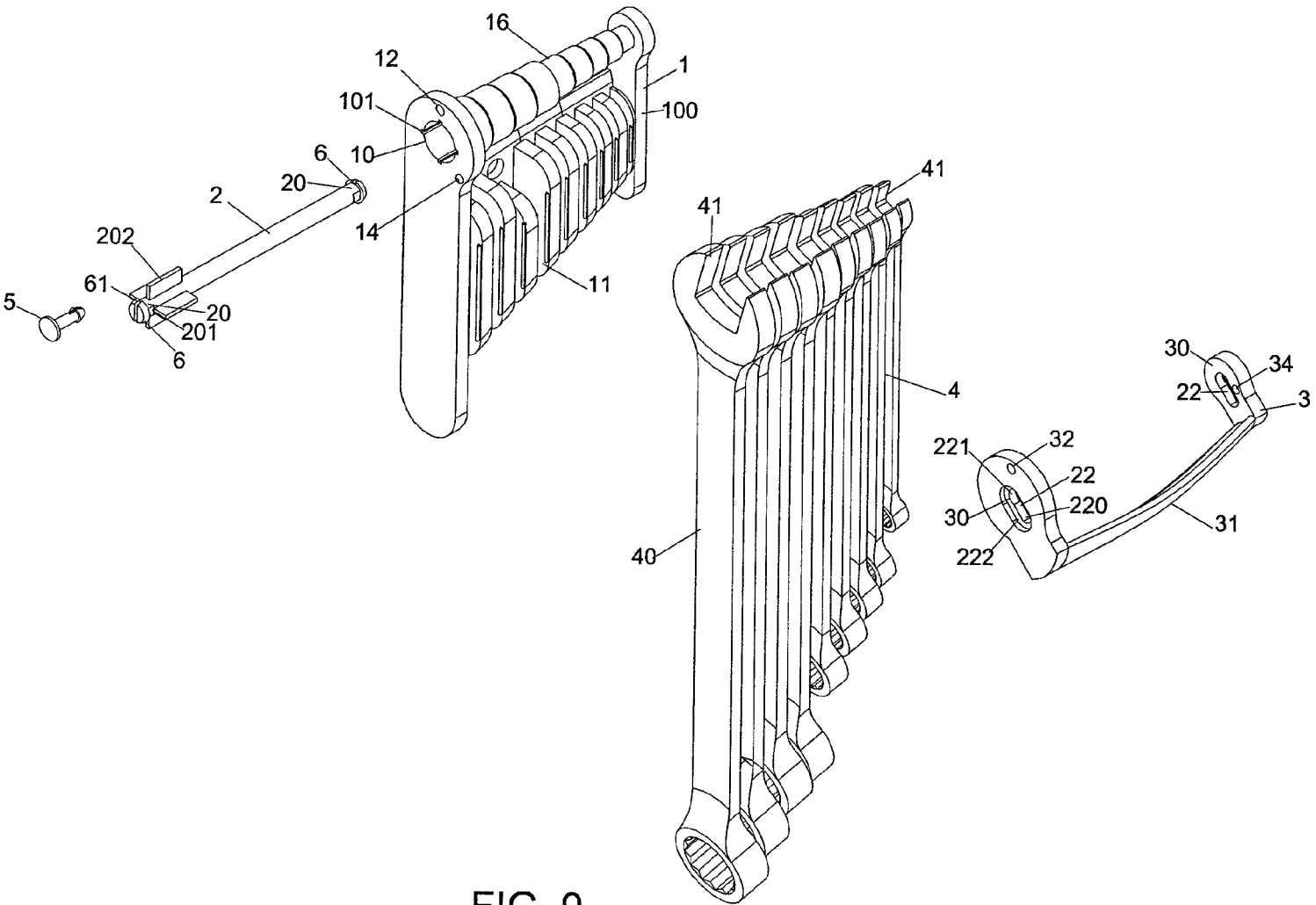
FIG. 9 is an exploded view of second embodiment of the present invention.

For the requirement of avoiding the connection portion 30 to depart from the pivot 20, the distal end of each pivot 20 is provided a clasper 6. One embodiment as shown in FIG. 1, the distal end of each pivot 20 is defined a concave 202 thereon, each concave 202 is engaged with a protrude 60 of a clasper 6, so that one distal end of each pivot 20 is provided with a clasper 6, and the clasper 6 has an outer diameter bigger than the pivot 20. Two opposite sides of the outer periphery of each pivot 20 each is provided with a limit portion 201. Another embodiment as shown in FIG. 9, the distal end of each pivot 20 is integrally formed a clasper 6 thereon, and the clasper 6 has a transversal trench 61 crosscutting from its distal end.

Figure 2:
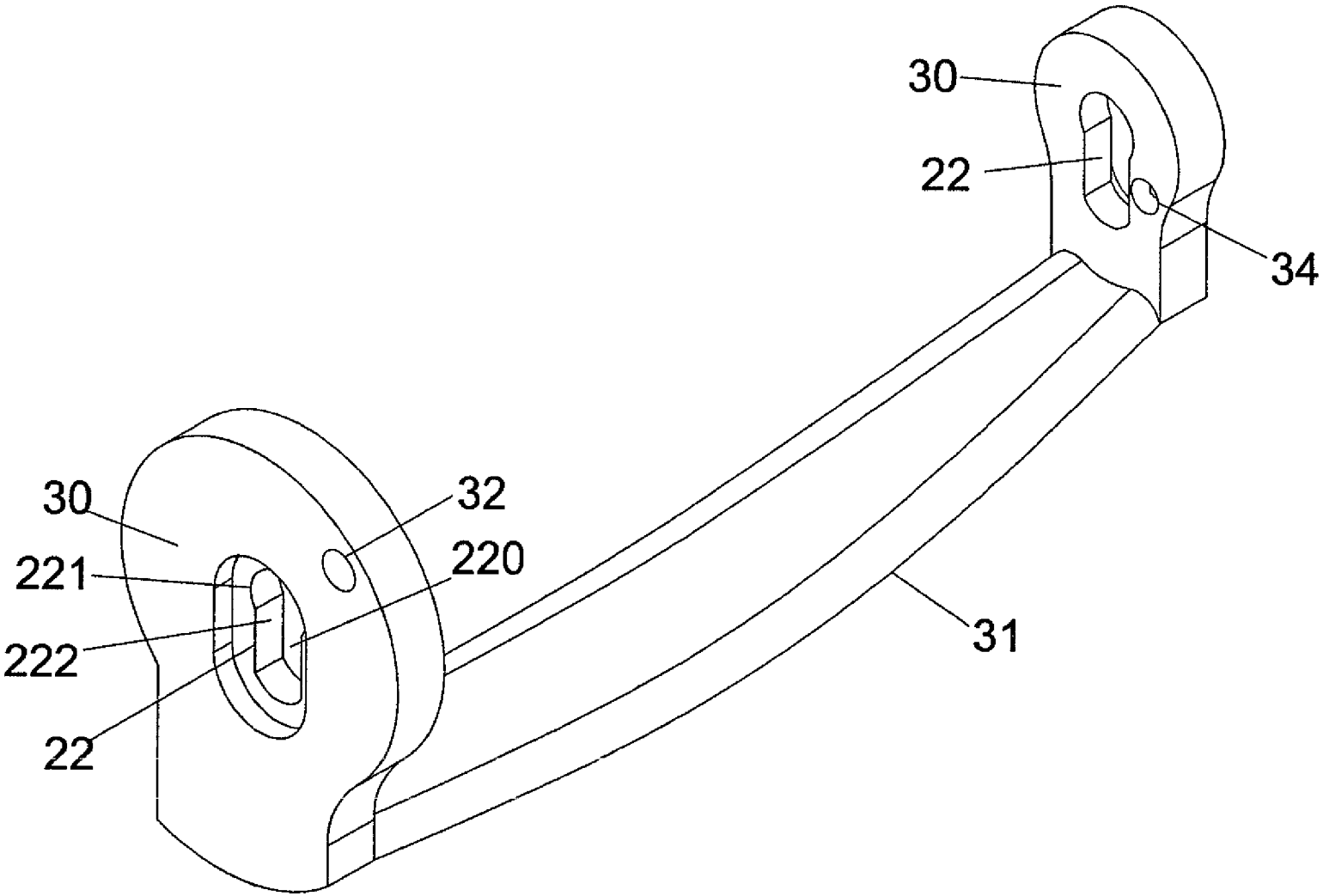
FIG. 2 is an enlarged view of the restriction member of the present invention.
Figure 3:
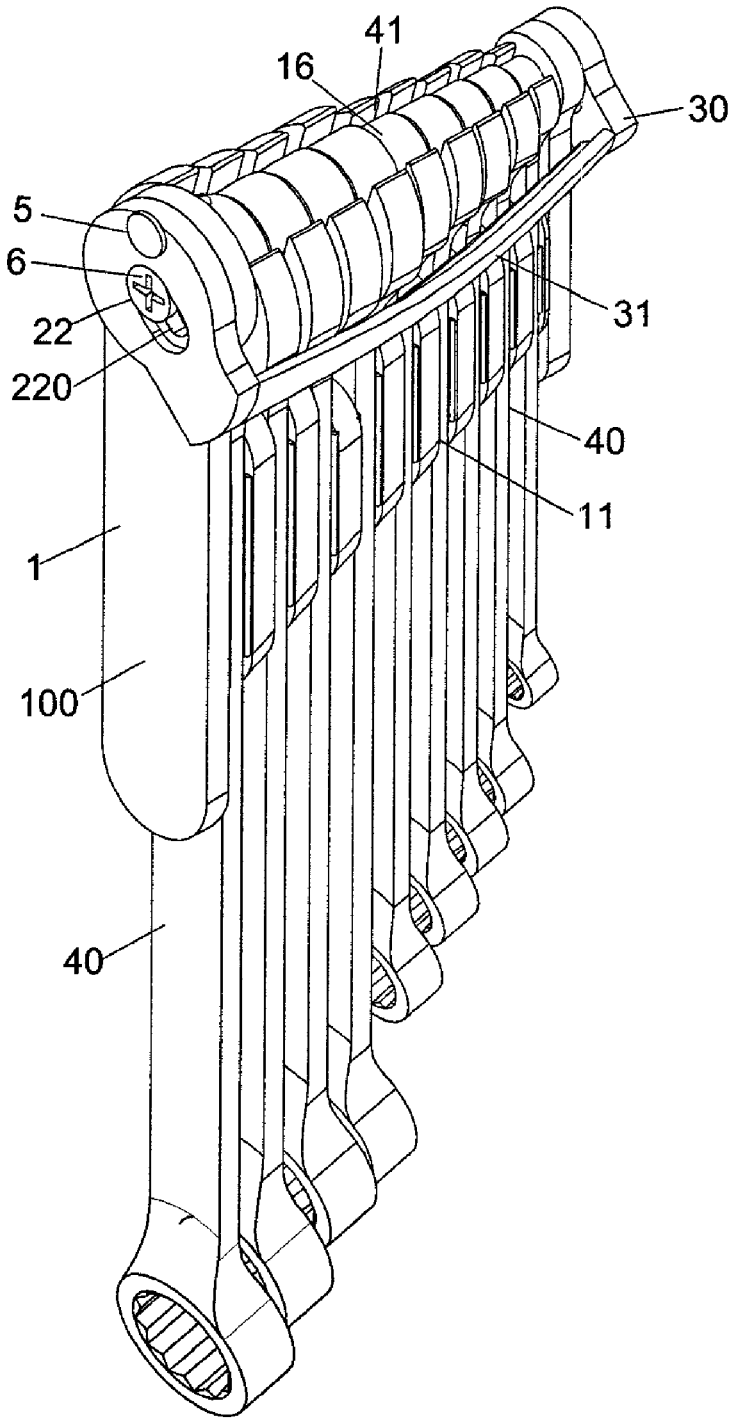
FIG. 3 is a perspective view to show the tool rack of the present invention and tools are received in the tool rack, wherein the restriction member is not yet rotated upward.
Figure 5:
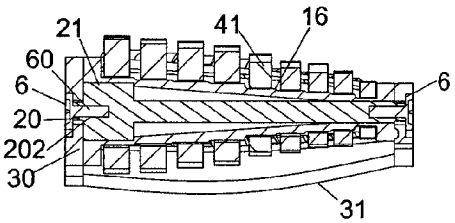
FIG. 5 is a cross sectional view, taken along line B-B in FIG. 4.
Figure 4:
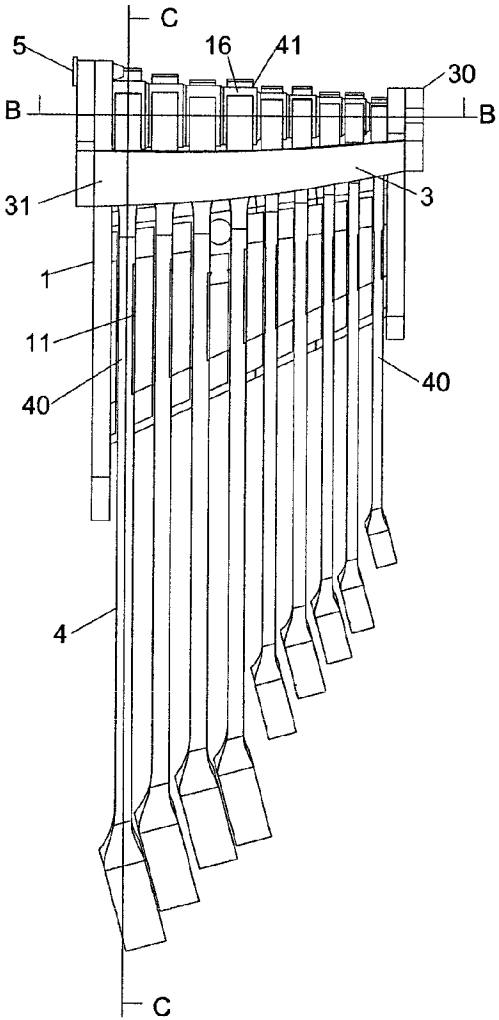
FIG. 4 is a front view to show the tool rack of the present invention and tools are received in the tool rack.
Figure 6:
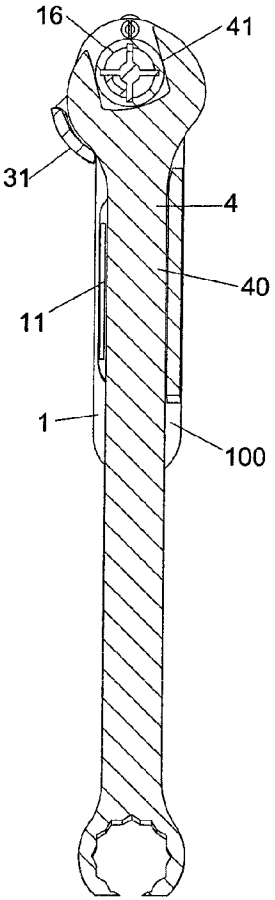
FIG. 6 is a cross sectional view, taken along line C-C in FIG. 4.

As shown in FIGS. 1 and 2, each positioning slot 22 includes interlinked a guiding slot 220 and a circular hole 221, the circular hole 221 is with a bigger outer diameter than the guiding slot 220. The two opposite sides of the inner wall of the guiding slot 220 each is provided a limit surface 222 thereon. The positioning slot 22 is penetrated by the pivot 20, and allows the pivot 20 to move along the circular hole 221 and the guiding slot 220.

Figure 7:
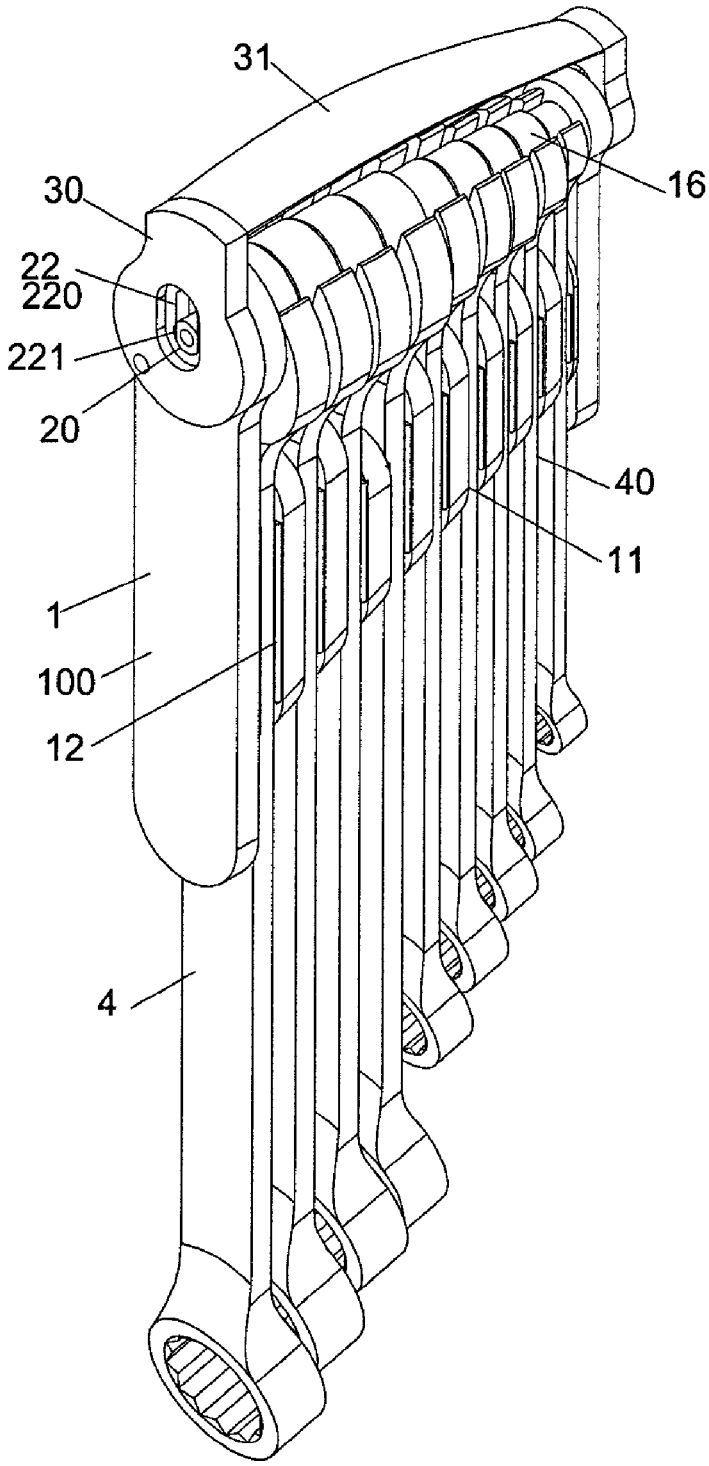
FIG. 7 is a perspective view to show the tool rack of the present invention and tools are received in the tool rack, wherein the restriction member is rotated upward.

As shown in FIG. 3~6, when the restriction bar 31 closes the recesses 11, the tools 4 can not be removed from the tool rack. On the contrary, as shown in FIG. 7, the pivot 20 is positioned in the circular hole 221, when pivoting the restriction member 3 upward, the restriction bar 31 is removed from the recesses 11 so that the tools 4 can be removed from the tool rack.

Figure 8:
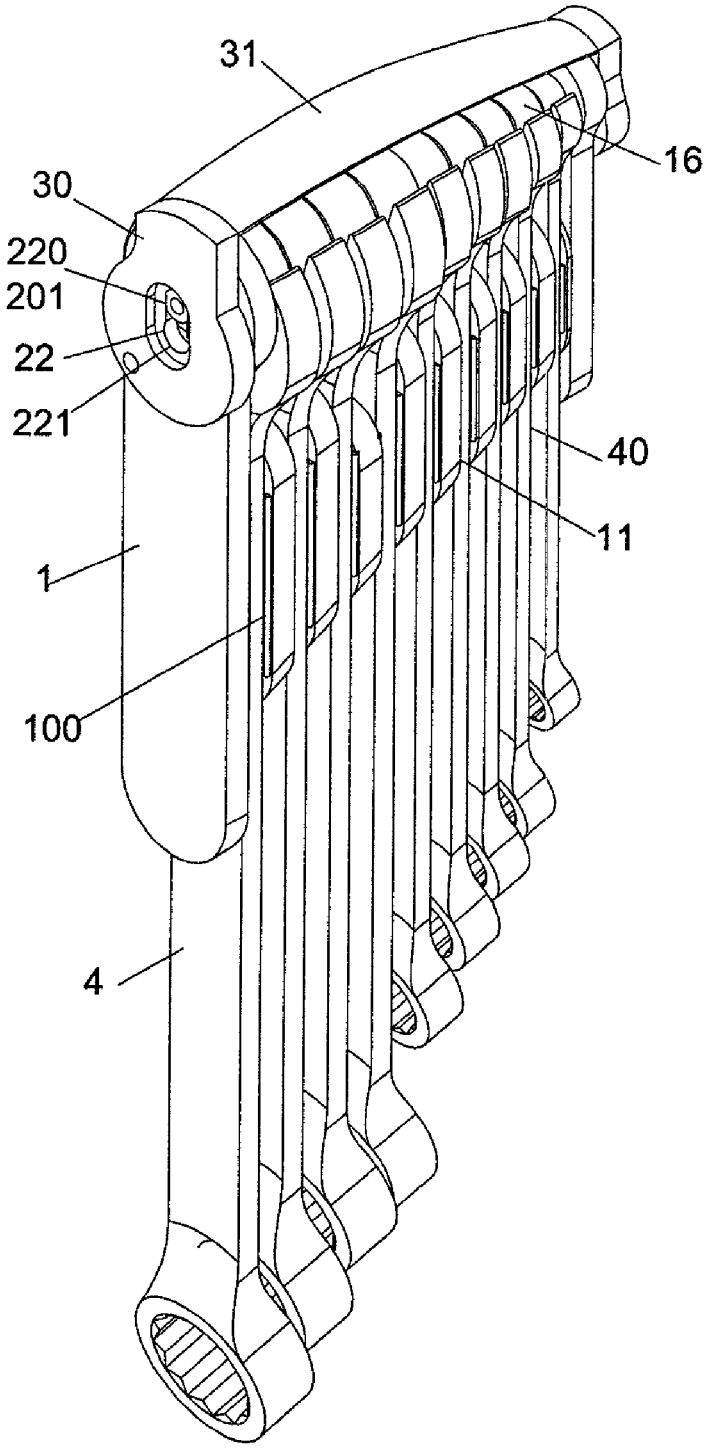
FIG. 8 is a perspective view to show the tool rack of the present invention and tools are received in the tool rack, wherein the restriction member is rotated upward and the restriction bar is shifted downward the top of the frame.

Further, as shown in FIG. 8, when pivoting the restriction member 3 on the top of the frame 1 and shifting downward, the restriction bar 31 and the connection portions 30 move downward with respect to the frame 1 and sidewall 100, so that the restriction bar 31 closes to the top of the frame and the pivot 20 is positioned in the guiding slot 220 with the limit surface 222 contact the limit portion 201, whereby the tools 4 can be removed from the tool rack for use, and the connection portions 30 and the restriction bar 31 can not be rotated with respect to the sidewall 100 and the frame 1 informally.

ii. Second Embodiment of the Pivotal Mechanism

Figure 10:
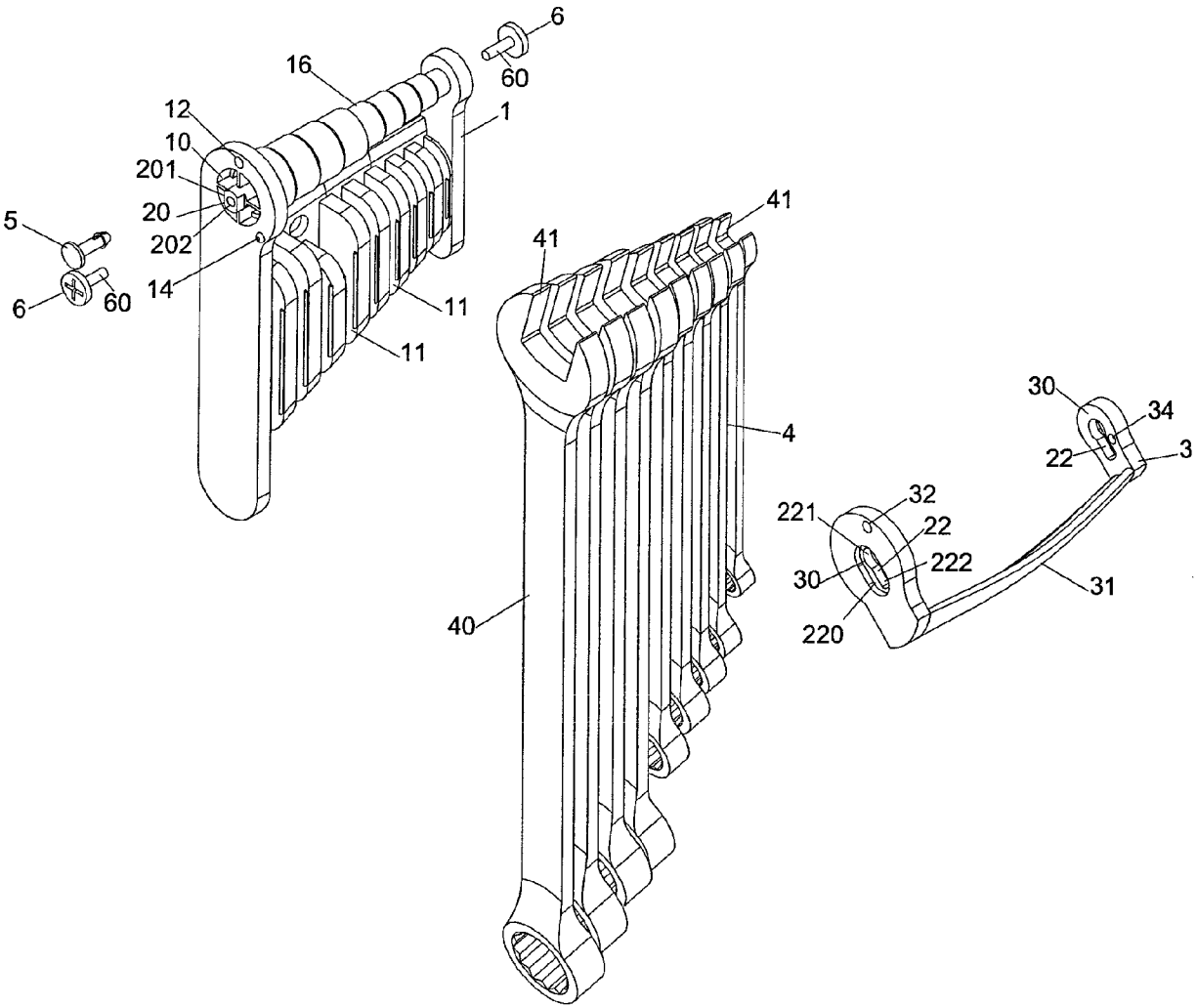
FIG. 10 is an exploded view of third embodiment of the present invention.

As shown in FIG. 10, two pivots 20 are defined on the two sidewalls 100 respectively, the pivots 20 partially protruding outward from the sidewall 100. Moreover, two positioning slots 22 are provided on the two connection portions 30 of the restriction member 3 respectively. As aforementioned configuration, two pivots 20 and two positioning slots 22 are provided on the sidewall 100 and the connection portions 30 respectively.

Figure 11:
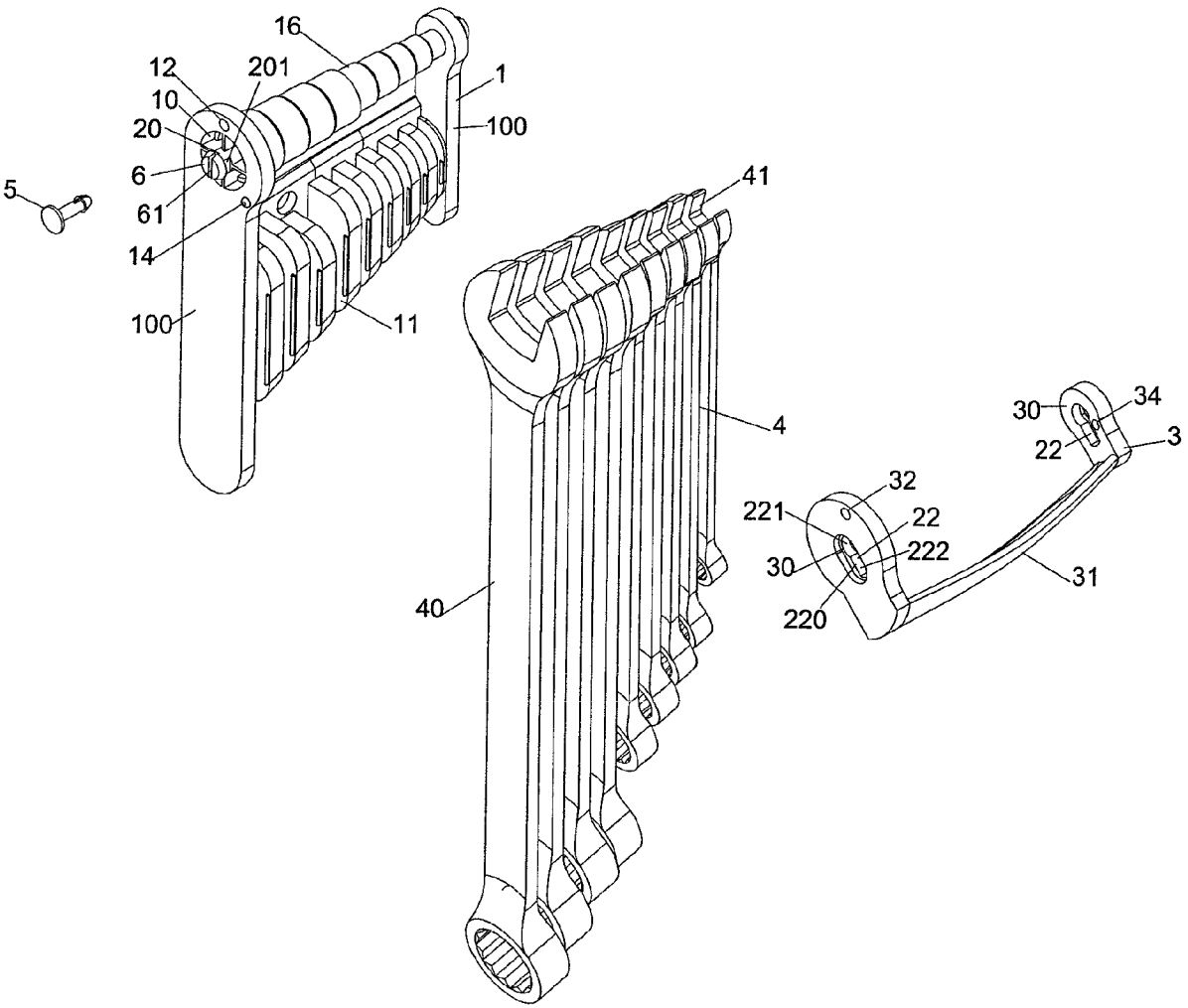
FIG. 11 is an exploded view of third embodiment of the present invention.

For the requirement of avoiding the connection portion 30 to depart from the pivot 20, the distal end of each pivot 20 is provided a clasper 6. One embodiment as shown in FIG. 10, the distal end of each pivot 20 is defined a concave 202 thereon, each concave 202 is engaged with a protrude 60 of a clasper 6, so that one distal end of each pivot 20 is provided with a clasper 6, and the clasper 6 has an outer diameter bigger than the pivot 20. Two opposite sides of the outer periphery of each pivot 20 each is provided with a limit portion 201. Another embodiment as shown in FIG. 11, the distal end of each pivot 20 is defined a clasper 6 thereon, and the clasper 6 has a transversal trench 61 crosscutting from its distal end.

As shown in FIG. 10, each positioning slot 22 includes interlinked a guiding slot 220 and a circular hole 221, the circular hole 221 is with a bigger outer diameter than the guiding slot 220. The two opposite sides of the inner wall of the guiding slot 220 each is provided a limit surface 222 thereon. The positioning slot 22 is penetrated by the pivot 20, and allows the pivot 20 to move along the circular hole 221 and the guiding slot 220.

iii. Third Embodiment of the Pivotal Mechanism

Figure 12:
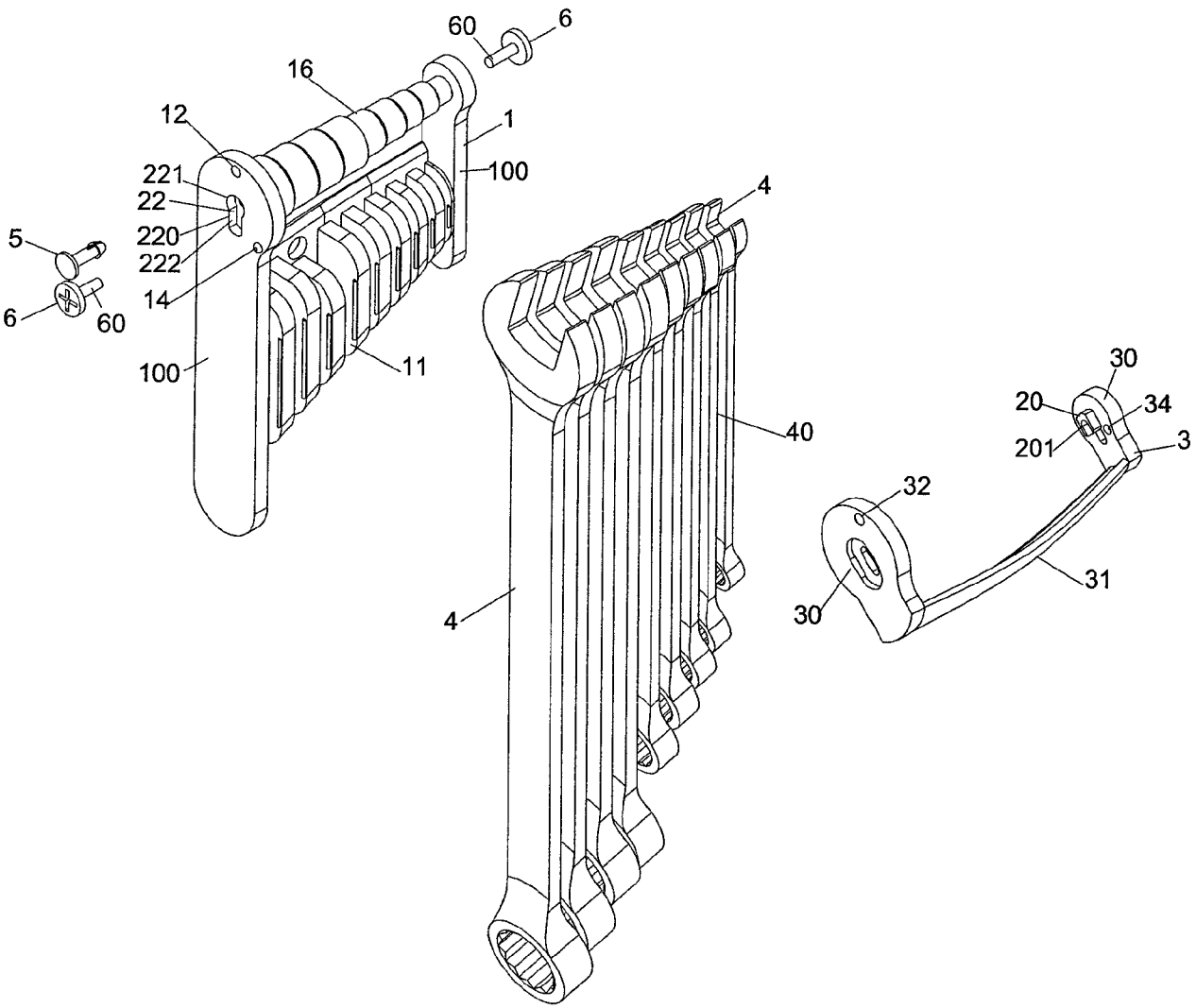
FIG. 12 is an exploded view of fourth embodiment of the present invention.

As shown in FIG. 12, two pivots 20 are defined on the two connection portion 30 of the restriction member 3 respectively, the pivot 20 partially protruding inward from the connection portion 30. Moreover, two positioning slots 22 are provided on the two sidewalls 100 of the frame 1. As aforementioned configuration, two positioning slots 22 and two pivots 20 are provided on the sidewall 100 and the connection portions 30 respectively.

The distal end of each pivot 20 is defined a concave 202 thereon, each concave 202 engaged with a protrude 60 of a clasper 6, so that one distal end of each pivot 20 is provided with a clasper 6, and the clasper 6 has an outer diameter bigger than the pivot 20. Two opposite sides of the outer periphery of each pivot 20 each is provided with a limit portion 201.

As shown in FIG. 12, each positioning slot 22 includes interlinked a guiding slot 220 and a circular hole 221, the circular hole 221 is with a bigger outer diameter than the guiding slot 220. The two opposite sides of the inner wall of the guiding slot 220 each is provided a limit surface 222 thereon. The positioning slot 22 is penetrated by the pivot 20, and allows the pivot 20 to move along the circular hole 221 and the guiding slot 220.

III. Conclusion

The present invention has following advantages:

1. Easy for use: the user pulls out the locking pin from the tool rack, and rotates the restriction bar 3 with respect to the frame 1 and in the position of unclosing the recess 11, then he can pick out the tool for use.

2. Simplified construction for easily fabrication: the restriction bar 31 needs not to be formed a plurality of second recesses matching with the recesses 11 of the frame 1, so it is in a simplified construction as to be easily fabricated.

While we have shown and described the embodiment in accordance with the present invention, it should be clear to those skilled in the art that further embodiments may be made without departing from the scope of the present invention.

What is claimed is:

1. A tool rack comprising:

a frame having two sidewalls and a plurality of recesses being defined in the frame each for engaging a shank of a tool;

a rod being connected between the two sidewalls opposite to the recesses, which is provided for the engagement of the function end of the tool; and a restriction member including a restriction bar and two connection portions, the two connection portions being provided on two ends of the restriction bar respectively and being pivotally connected to the two sidewalls of the frame by a pivotal mechanism, so that the restriction member is able to rotate with respect to the frame, and the restriction bar is able to close the recesses;

wherein, the pivotal mechanism comprising:

two pivots and two positioning slots being provided on the sidewalls of the frame and the connection portions of the restriction member respectively, and one end of the pivot provided with a clasper with an outer diameter bigger than the pivot; each positioning slot including interlinked a guiding slot and a circular hole, the circular hole having a bigger diameter than the width of the guiding slot; each positioning slot being penetrated by one pivot and allowing the pivot to move along the circular hole and the guiding slot; and two opposite sides of the inner wall of the guiding slot being provided a limit surface thereon respectively, and two opposite sides of the outer periphery of the pivot being provided a limit portion thereon respectively;

so that the connection portions and the restriction bar are unable to be rotated with respect to the sidewall and the frame when the pivot is positioned in the circular hole, and the connection portions and the restriction bar are unable to be rotated with respect to the sidewall and the frame when the pivot is positioned in the guiding slot and the limit surface is in contact with the limit portion.

2. The tool rack as claimed in claim 1, wherein the two pivots are defined on two ends of a shaft respectively, each sidewall includes a hole, the periphery of shaft is defined by at least a flange thereon, the inner wall of one hole defined by at least a slot thereon, the shaft is inserted in the rod along the longitudinal line of the rod, the flange engages with the slot and the pivots partially protrude outward from the hole with respect to the sidewall, and the two positioning slots are provided on the two connection portions of the restriction member respectively.

3. The tool rack as claimed in claim 1, wherein the distal end of each pivot is provided a clasper thereon, the clasper has an outer diameter bigger than the outer diameter of the pivot.

4. The tool rack as claimed in claim 3, wherein the distal end of the pivot is defined by a concave thereon, the concave is engaged with a protrude of the clasper.

5. The tool rack as claimed in claim 3, wherein the clasper is integrally formed on the distal end of the pivot, and the clasper has a transversal trench crosscutting from its distal end.

6. The tool rack as claimed in claim 1, wherein the two pivots are defined on the two sidewalls respectively, the pivots partially protruding outward from the sidewall, and the two positioning slots are provided on the two connection portions of the restriction member respectively.

7. The tool rack as claimed in claim 1, wherein the two pivots are defined on the two connection portion of the restriction member respectively, the pivot partially protruding inward from the connection portion, the two positioning slots are provided on the two sidewalls of the frame respectively.

8. The tool rack as claimed in claim 1, wherein the connection portion of the restriction member includes a through hole, a locking pin extends through the through hole and engages with a snap hole on the sidewall of the frame.

9. The tool rack as claimed in claim 1, wherein the connection portion of the restriction member includes a cavity which is provided for engaging with a protruding on the sidewall.

10. The tool rack as claimed in claim 1, wherein a protrusion extends from at least one inside of each recess so as to form a narrow opening for holding the shank of the tool.

* * * * *